US007038647B2

(12) United States Patent
Shigeta et al.

(10) Patent No.: US 7,038,647 B2
(45) Date of Patent: May 2, 2006

(54) LIQUID CRYSTAL DISPLAY APPARATUS

(75) Inventors: Mitsuhiro Shigeta, Uji (JP); Makoto Shiomi, Tenri (JP); Kazunari Tomizawa, Kyoto (JP); Hidekazu Miyata, Nagoya (JP)

(73) Assignee: Sharp Kabushiki Kaisha, Osaka (JP)

( * ) Notice: Subject to any disclaimer, the term of this patent is extended or adjusted under 35 U.S.C. 154(b) by 304 days.

(21) Appl. No.: 10/384,517

(22) Filed: Mar. 11, 2003

(65) Prior Publication Data

US 2003/0179175 A1 Sep. 25, 2003

(30) Foreign Application Priority Data

Mar. 25, 2002 (JP) ..... 2002-084225

(51) Int. Cl.
*G09G 3/36* (2006.01)

(52) U.S. Cl. ..... 345/89; 345/301; 345/302; 345/690

(58) Field of Classification Search ..... 345/89, 345/690, 301, 302
See application file for complete search history.

(56) References Cited

U.S. PATENT DOCUMENTS 6,466,225 B1 10/2002 Larkin et al.
2002/0050965 A1* 5/2002 Oda et al. ..... 345/87

FOREIGN PATENT DOCUMENTS

| | | |
|---|---|---|
| JP | 03-236733 | 10/1991 |
| JP | 04-318516 | 11/1992 |
| JP | 04-365094 | 12/1992 |
| JP | 07-056532 | 3/1995 |
| JP | 09-097036 | 4/1997 |
| JP | 10/39837 | 2/1998 |
| JP | 11-109927 | 4/1999 |
| JP | 11-113019 | 4/1999 |
| JP | 2001-056458 | 2/2001 |

(Continued)

OTHER PUBLICATIONS

Japanese Office Action dated Apr. 12, 2005.

(Continued)

*Primary Examiner*—Kent Chang
*Assistant Examiner*—Ke Xiao
(74) *Attorney, Agent, or Firm*—Harness Dickey & Pierce, P.L.C.

(57) ABSTRACT

A liquid crystal display apparatus includes an applied gradation value acquiring section for receiving gradation data of a frame to be displayed, gradation data of a frame to be outputted, gradation data of the current frame supplied from a frame memory and measured data from a temperature sensor. An interpolation operation is then carried out in reference to look-up tables stored in a look-up table memory so as to calculate a target applied gradation data required for gradation display. The section sets for each LUT (a) a coordinate system in which a lattice point is represented by a combination of the gradation data of the current frame and the gradation data of the target frame and (b) a local coordinate system having lattice points corresponding to the target gradation data in the coordinate system; carries out interpolation operation by use of the local coordinate system, and carries out further interpolation operation based on the interpolated value (table interpolated value), in accordance with the measured data so as to calculate the target applied gradation data. The adoption of the interpolation by use of the local coordinate system enables the finding of the target applied gradation data (interpolated value) with higher accuracy, while a variety of additional conditions are taken into consideration.

36 Claims, 7 Drawing Sheets

FOREIGN PATENT DOCUMENTS

| | | |
|---|---|---|
| JP | 2001-343955 | 12/2001 |
| JP | 2002-041016 | 2/2002 |
| JP | 2002-082657 | 3/2002 |

OTHER PUBLICATIONS

Korean Office Action dated Apr. 28 2005.

* cited by examiner

FIG. 3 (a)

TABLE 1

| GRADATION | 0 | 32 | 64 | 96 | 128 | 160 | 192 | 224 | 255 |
|---|---|---|---|---|---|---|---|---|---|
| 0 | 0 | 88 | 134 | 166 | 186 | 204 | 220 | 238 | 255 |
| 32 | 0 | 32 | 92 | 118 | 151 | 186 | 215 | 238 | 255 |
| 64 | 0 | 24 | 64 | 105 | 148 | 182 | 214 | 236 | 255 |
| 96 | 0 | 24 | 62 | 96 | 138 | 170 | 204 | 234 | 255 |
| 128 | 0 | 24 | 42 | 82 | 128 | 168 | 203 | 233 | 255 |
| 160 | 0 | 24 | 38 | 68 | 116 | 160 | 197 | 228 | 255 |
| 192 | 0 | 16 | 30 | 66 | 108 | 150 | 192 | 230 | 255 |
| 224 | 0 | 8 | 28 | 60 | 102 | 142 | 182 | 224 | 255 |
| 255 | 0 | 0 | 22 | 50 | 89 | 128 | 180 | 220 | 255 |

TARGET-GRADATION VALUE

CURRENT GRADATION VALUE

FIG. 3 (b)

TABLE 2

| GRADATION | 0 | 32 | 64 | 96 | 128 | 160 | 192 | 224 | 255 |
|---|---|---|---|---|---|---|---|---|---|
| 0 | 0 | 156 | 206 | 228 | 242 | 248 | 255 | 255 | 255 |
| 32 | 0 | 32 | 142 | 192 | 208 | 232 | 248 | 255 | 255 |
| 64 | 0 | 0 | 64 | 123 | 158 | 186 | 224 | 255 | 255 |
| 96 | 0 | 0 | 32 | 96 | 145 | 177 | 216 | 242 | 255 |
| 128 | 0 | 0 | 20 | 56 | 128 | 173 | 215 | 242 | 255 |
| 160 | 0 | 0 | 0 | 44 | 80 | 160 | 208 | 239 | 255 |
| 192 | 0 | 0 | 8 | 36 | 76 | 128 | 192 | 235 | 255 |
| 224 | 0 | 0 | 0 | 24 | 64 | 108 | 160 | 224 | 255 |
| 255 | 0 | 0 | 0 | 0 | 16 | 88 | 128 | 192 | 255 |

TARGET-GRADATION VALUE

CURRENT GRADATION VALUE

LIQUID CRYSTAL DISPLAY APPARATUS

The present application hereby claims priority under 35 U.S.C. §119 on Japanese patent application number 2002-84225 filed Mar. 25, 2002, the entire contents of which are hereby incorporated by reference.

FIELD OF THE INVENTION

The present invention generally relates to a liquid crystal display apparatus. Preferably, it relates to one used in a television set, in an OA (Office Information) device, and as a monitor for a CAD (Computer Aided Design) system.

BACKGROUND OF THE INVENTION

A liquid crystal display apparatus has almost become an image display apparatus that is superior to a cathode ray tube because of (a) features such as small-footprint and power savings and (b) recent improvement in performance such as viewing angle, contrast, color reproducibility, and response speed. Thus, it is anticipated that such a liquid crystal display apparatus may be more often and widely applied to a monitor for a television set, office automation, etc. in future.

In general, when a liquid crystal cell receives a voltage, the major axis (director) of a liquid crystal material (liquid crystal molecule) in the liquid crystal cell is changed due to its dielectric anisotropy. Because the liquid crystal material has optical anisotropy, the polarization direction of the light that transmits through the liquid crystal cell is also changed in response to the change in the major axis. The amount of light that transmits through the liquid crystal cell is controlled, via a member in the liquid crystal cell such as a polarizing plate, in response to a voltage (an applied voltage) which is applied to the liquid crystal cell. This ensures that each pixel displays with a target gradation luminance so as to carry out the image display.

However, it takes some time for the liquid crystal material to respond to a change in the applied voltage, because the response speed of the liquid crystal material is slow. For instance, in the case of TN (Twisted Nematic), IPS (In-Plane-Switching), or VA (Vertically Aligned) in a liquid crystal display system (liquid crystal display mode) that has been widely used, the response speed of the liquid crystal material between slow gradations corresponds to 30 msec to 50 msec. Thus, it is not possible to realize the response speed that corresponds to 60 Hz (about 16.6 msec) of NTSC (National Television System Committee) signal or 50 Hz (about 20.0 msec) of PAL (Phase Alternation by Line). In order to meet the requirement of market expansion, higher performance appears to be necessary.

In view of the foregoing circumstances, a conventional liquid crystal display apparatus, in which the driving method for displaying the liquid crystal material is contrived so as to improve the response speed, has been studied and developed.

For instance, Japanese unexamined patent publication No. 10-39837 (publication date: Feb. 13, 1998) discloses a liquid crystal display apparatus adopting "overshoot-driving". In such a liquid crystal display apparatus, a voltage greater than a corresponding voltage difference is applied during the change in gradation so as to rapidly move the liquid crystal material to a target gradation. In the overshoot-driving, look-up tables (LUTs) are prepared in advance in which gradation values (applied gradation values) to be applied to the liquid crystal material are set in association with respective start (current) and target (desired) gradations, and the voltage is applied in accordance with the LUT. The gradation values may be applied voltages that realize the applied gradation.

According to the arrangement of the publication, however, the LUTs would desirably be prepared by finding, in advance, applied voltages (applied voltages for all the gradations) corresponding to all the patterns of gradation change. This causes the problem that the capacity of the memory storing the LUTs becomes extremely large.

Further, according to the arrangement of the publication, it is sometimes impossible to appropriately carry out the overshoot-driving under some additional condition, such as temperature, of the liquid crystal display apparatus, thereby causing another problem that it is not possible to carry out natural and high-speed display.

More specifically, the response speed of the liquid crystal display apparatus remarkably changes in response to the change in the viscosity of the liquid crystal material due to the temperature change of the liquid crystal display apparatus. This results in that the overshoot-driving is not fully effective in lower temperatures due to the decreasing of the response speed of the liquid crystal material, when the LUTs are used in which the applied gradations are set at room temperatures. This causes the response speed not to be fully fast, so that the writing can not be in time. In contrast, the overshoot-driving becomes too strong at higher temperatures. This results in that the display is carried out in which white and black are excessively emphasized. This causes the display characteristics to be damaged.

In order to address the problem, a system is conceivable in which a plurality of LUTs is prepared for each temperature in advance and an optimum LUT is automatically selected as a target LUT to be used from among the LUTs in response to a temperature sensor so as to match for the temperature of the liquid crystal display apparatus. However, in view of the capacity of the memory storing the LUTs, it is actually difficult to prepare LUTs for all the gradations and for all the temperatures.

Furthermore, the foregoing explanation only deals with the case where the additional condition is temperature. There are other factors than temperature that cause the response speed of the liquid crystal display apparatus to change. Namely, the additional condition may include the thickness of the cell of display panel and the frequency of the image, for example. Thus, it is very difficult to prepare all the LUTs for the respective additional conditions.

SUMMARY OF THE INVENTION

The present application is made for solving the foregoing problems, and an object of an embodiment of the present application is to reduce the capacity of memory storing LUTs by use of interpolation operations. Another object may be to provide a liquid crystal display apparatus that carries out an appropriate overshoot-driving in accordance with additional conditions such as temperature for example so as to carry out natural and high-speed display.

A liquid crystal display apparatus in accordance with an embodiment of the present invention changes a voltage applied to a liquid crystal so as to carry out a gradation display and sets applied gradation values to be actually applied to the liquid crystal so as to be associated with a current gradation of a first frame and a desired or target gradation of a second frame, the first frame being one frame earlier than the second frame. The apparatus may be provided with: (a) a plurality of look-up tables, prepared so that thinning is carried out with respect to gradations, in which the applied gradation values are stored, and (b) an applied gradation value acquiring section for acquiring, as the applied gradation value, in reference to the look-up tables, a value that is interpolated by use of applied gradation values stored in the look-up tables when a target applied gradation value is not stored in the look-up tables.

With an arrangement, the voltage to be applied to the liquid crystal is changed so as to carry out the gradation display. At this time, the applied gradation values to be actually applied to the liquid crystal are set so as to be associated with the current gradation of the first frame and the desired target gradation of the second frame, the first frame being one frame earlier than the second frame.

According to the conventional liquid crystal display apparatus, the overshoot-driving is adopted which causes the liquid crystal material to rapidly move to a target gradation. In the overshoot-driving, the look-up tables (LUTs) are prepared in advance in which the gradation values (applied gradation values) to be applied to the liquid crystal material are set, and the voltage is applied in accordance with the LUTs. In this case, the LUTs are prepared by finding, in advance, the applied voltages (applied voltages for the entire gradations) corresponding to all the patterns of gradation change. This causes the problem that the capacity of the memory storing the LUTs becomes extremely large.

In view of the deficiency, the look-up tables of an embodiment of the present application are prepared so that the thinning is carried out with respect to gradations. Accordingly, it is possible to much further reduce the capacity of memory, as compared with the case where the applied voltages corresponding to all the gradations are found.

The present liquid crystal display apparatus is further provided with an applied gradation value acquiring section. The applied gradation value acquiring section acquires as the applied gradation value, in reference to the look-up tables, a value that is interpolated by use of applied gradation values stored in the tables when a target applied gradation value is not stored in the look-up tables. Note that the applied gradation value acquiring section acquires the applied gradation value stored in the look-up table when the target applied gradation value is stored in the look-up table.

It is preferable that the applied gradation value acquiring section carries out an interpolation operation by use of a local coordinate system defined by respective axes for the current gradation and the desired target gradation. In this case, since the local coordinate system is adopted, the accuracy of interpolation improves, accordingly.

It is further preferable that the look-up tables are prepared in accordance with additional conditions causing a response characteristic of the liquid crystal to change, and prepared so that thinning is carried out with respect to the additional conditions. Further, the applied gradation value acquiring section preferably acquires, as the applied gradation value, a value that is interpolated by use of applied gradation values stored in the tables when a target look-up table that is in conformity with a target additional condition does not exist.

In the conventional liquid crystal display apparatus, it is sometimes impossible to appropriately carry out the overshoot-driving, thereby making it impossible to carry out the natural and high-speed display. In view of the deficiency, according to the present liquid crystal display apparatus, the look-up tables are prepared in accordance with additional conditions causing a response characteristic of the liquid crystal to change, and we prepared so that the thinning is carried out with respect to the additional conditions.

Thus, despite of the consideration of at least one additional condition, since the look-up tables are prepared so that the thinning is carried out with respect to the additional conditions, it is possible to appropriately carry out the overshoot-driving in accordance with the additional condition without increasing the capacity of memory, thereby making it possible to carry out the natural and high-speed display.

In the applied gradation value acquiring section, when the target look-up table that is in conformity with the target additional condition does not exist, the applied gradation value that is calculated based on the content which has been stored in the look-up table. Note that when the target look-up table that is in conformity with the target additional condition exists, the applied gradation value obtained based on the content that is stored in the look-up table is used.

For a fuller understanding of the nature and advantages of the invention, reference should be made to the ensuing detailed description taken in conjunction with the accompanying drawings which sets forth exemplary aspects of the invention using non-limiting exemplary embodiments.

BRIEF DESCRIPTION OF THE DRAWINGS

FIG. 3(*a*) is an explanatory view showing a look-up table (Table 1) at 40° C., and FIG. 3(*b*) is an explanatory view showing a look-up table (Table 2) at 0° C.

DESCRIPTION OF THE EMBODIMENTS

First Embodiment

The following description deals with an embodiment of the present invention with reference to FIGS. 1 through 4. Note that the present invention is not limited to the description.

Figure 2:
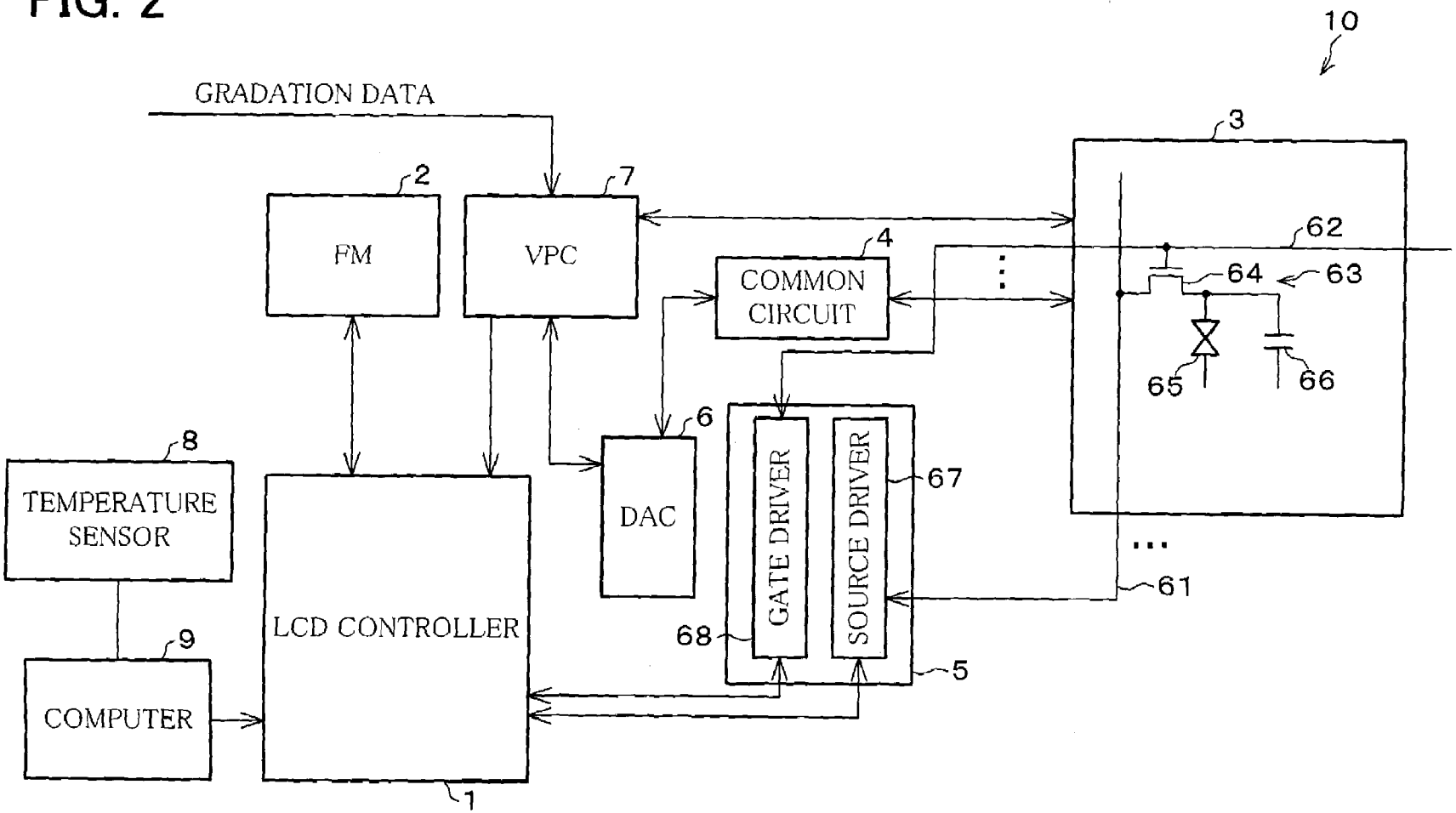
FIG. 2 is a block diagram showing the liquid crystal display apparatus including the members that carry out the interpolation operation.

FIG. 2 is a block diagram showing an arrangement of a liquid crystal display apparatus (LCD 10) in accordance with the present embodiment.

The LCD 10 includes a liquid crystal panel 3, a common circuit 4, a gradation circuit 5, a digital/analog converter (DAC) 6, an LCD controller 1, a frame memory (FM) 2, a video processing controller (VPC) 7, a temperature sensor 8, and a computer 9.

The liquid crystal panel 3 includes a substrate (screen) on which pixels are provided. For instance, a plurality of source bus lines 61 are provided so as to be parallel to each other in the longitudinal direction of the screen, and a plurality of scanning lines 62 are provided so as to be parallel to each other in the transverse direction of the screen.

The source bus lines 61 and the scanning lines 62 are intersected with each other. Pixels 63 are provided for the respective intersections of the lines 61 and 62. Each pixel 63 is provided with a TFT 64, a liquid crystal cell 65, and a load capacity 66. The drain of the TFT 64 is connected with one end of the liquid crystal cell 65, and the other end is connected with a common electrode (not shown) that is shared among all the pixels.

The common circuit 4 is provided for generating a common voltage that is supplied to the common electrode. The gradation circuit 5 is provided for setting an applied voltage in accordance with gradation data (applied gradation value) that is sent from the LCD controller 1. The gradation circuit 5 is provided outside the liquid crystal panel 3, and includes a source driver 67 and a gate driver 68. The source bus lines 61 are connected with the source driver 67, and the scanning lines 62 are connected with the gate driver 68.

Figure 1:
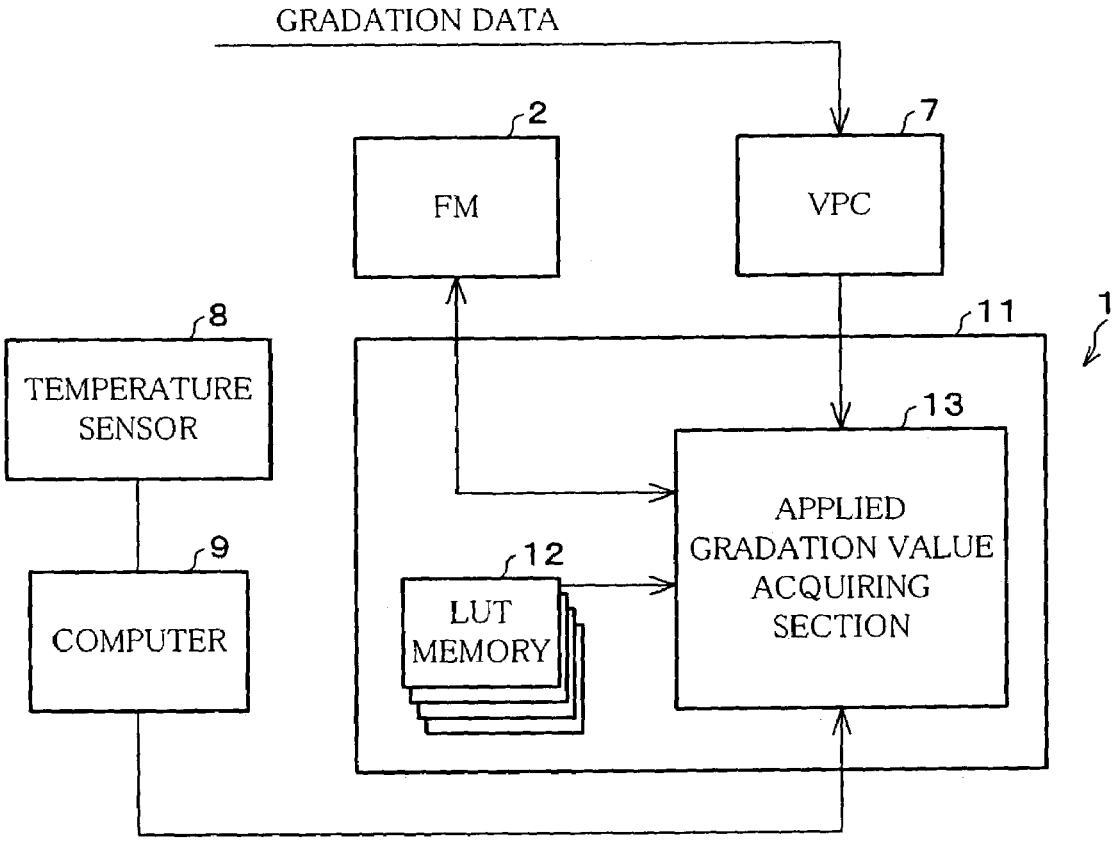
FIG. 1 is a block diagram showing members that carry out the interpolation operation in a liquid crystal display apparatus of an embodiment in accordance with an embodiment of the present invention.

The DAC 6 is provided for generating a reference voltage in the gradation circuit 5. The LCD controller 1 includes an interpolation operation device 11 such as FPGA (Field-Programmable Gate Array) or GA as shown in FIG. 1. The LCD controller 1 is provided for controlling the source driver 67 and the gate driver 68. The interpolation operation device 11 will be described later in detail.

As shown in FIG. 2, the LCD controller 1 supplies the gradation data (image data) to the source driver 67 via the source bus lines 61. The gradation data specifies the applied voltage to be written into the respective pixels. The LCD controller 1 supplies to the gate driver 68 a signal for specifying a scanning timing. The LCD controller 1 supplies to the source driver 67 a signal for changing over and outputting an applied voltage in synchronism with the scanning timing. The LCD controller 1 also controls the timing of a driving signal to be supplied to the common electrode. Note that the gradation here is converted into digital data by the VPC 7.

The FM 2 is a memory that can store the gradation data corresponding to one frame. Accordingly, for instance, it is possible for the FM2 to carry out simultaneous processing for the input and output of data. It is also possible to delay the gradation data via the FM2 by one frame with simple structure. The VCP 7 is provided for converting the gradation data into the digital data as described above.

The temperature sensor 8 makes a temperature measurement of the liquid crystal display apparatus (i.e., a temperature measurement of the installation location of the liquid crystal display), i.e., monitors the temperature. Of course, if other additional conditions are to be included, additional or alternative sensors (not shown), as known by those of ordinary skill, can be used and/or substituted to determine other additional conditions including, but not limited to cell gap, thickness of the cell, and/or image frequency. The computer 9 supplies to the interpolation operation device 11 (i.e., later described applied gradation value acquirement section 13) the data corresponding to the physical data such as temperature data (measured data) from the temperature sensor 8, the cell thickness of the liquid crystal panel, and frequency of an image (frame frequency), for example.

In the LCD 10, when a piece of image (frame) is displayed by the liquid crystal panel 3, the TFT 64 connected with each scanning line 62 is sequentially turned on by the gate driver 68 for each scanning line 18, while an applied voltage, which varies depending on the gradation data (applied gradation value) corresponding to each scanning line 62, is supplied (or written) to the pixel that corresponds to each scanning line 62.

With the liquid crystal display apparatus in accordance with the present embodiment, since the interpolation operation is carried out in consideration of the additional condition such as temperature, it is possible to find a target interpolation value (target gradation data) with high accuracy.

The interpolation operation is performed by the interpolation operation device 11. The interpolation operation device 11 includes a look-up table memory (LUT memory) 12 and the applied gradation value acquirement section 13, as shown in FIG. 1. The LUT memory 12 stores a plurality of look-up tables (LUTs).

The LUT stores the gradation data (applied gradation value) corresponding to a voltage to be applied to the liquid crystal material (liquid crystal layer), provided that the gradation data (referred to as target gradation value) of a frame and the gradation data (referred to as current gradation value) of a frame that is one frame earlier than the frame are known, respectively.

More specifically, as shown in FIGS. 3(*a*) and 3(*b*), the longitudinal axis represents the current gradation value while the transverse axis represents the desired target gradation value in local coordinate space. The current gradation value and the target gradation value are set by the finite number of gradations. There is provided a predetermined interval between the gradations. In FIGS. 3(*a*) and 3(*b*), the gradation values are set for every 32-gradations. Note that the present application is not limited to such settings for every 32 gradations, and may be set for any number of gradations. Further, the current and target gradation settings need not be the same. Additionally, note that the settings need not be for equal gradations as they could change from every 32, to every 64, to every 128 within a single table, for example. Also, note that the respective numeric values of the gradation values (the current gradation values and target gradation values) and the gradation data (the applied gradation value) are represented by the quotation mark (" "), for convenience.

In the case where the operating temperature range of the liquid crystal display apparatus in accordance with the present embodiment falls between 40° C. and 0° C., the LUT memory 12 stores two LUTs, i.e., Table 1, as shown in FIG. 3(*a*), for high temperature (40° C.) and Table 2, as shown in FIG. 3(*b*), for low temperature (0° C.).

The applied gradation value acquiring section 13 uses (a) the gradation value (the current gradation value), received from the FM2, of a frame, (b) the gradation value (the target gradation value) received via the VPC 7, and (c) the temperature data (measured data) received from the temperature sensor 8 via the computer 9. In reference to the stored LUTs, the applied gradation value acquiring section 13 calculates (i.e., carries out the interpolation operation for) the gradation data (i.e., the applied gradation value) that is not stored in the LUTs.

The following description deals with the interpolation operation that is carried out during displaying of the image by use of the overshoot-driving, especially deals with in detail how to calculate as the target gradation data the gradation data which have not been stored of the LUTs.

The new applied gradation data (i.e., the applied gradation value calculated by the interpolation operation) can be found in accordance with the following procedures. Note for easier understanding, the following procedures deal with an exemplary situation where the interpolation value required for changing the current gradation value "55" into the target gradation value "90" at 20° C. is calculated.

(Procedure 1)

First, the first Interpolation operation is carried out between the current gradation value and the target gradation value in an LUT, for instance, Table 1.

In Table 1, when it is intended to change the current gradation value "55" into the target gradation value "90", i.e., when it is intended to find a value (the gradation data: the first interpolation value H) required for changing the current gradation value "55" of the frame into the target gradation value "90" of the new frame, a coordinate system (see FIG. 4) is introduced for (a) current gradation values "32" through "64" in which the current gradation value "55" is included and (b) target gradation values "64" through "96" in which the target gradation value "90" is included.

Then, in the coordinate system, a point represented by the combination of the target gradation value "64" and the current gradation value "32" is assumed to be origin of coordinates P21. A local coordinate system 9*a* type of matrix) is set which has (i) a target gradation local axis (ξ-axis) extending from the origin of coordinates P21 to a same direction as the target gradation value axis and (ii) a current gradation local axis (η-axis) extending from the origin of coordinates P21 to a same direction as the current gradation value axis. Accordingly, the origin of coordinates P21 is represented by (ξ, η)=(0, 0) in the local coordinate having the target gradation local axis (ξ-axis) and the current gradation local axis (η-axis).

When representing an area enclosed by the current gradation values "32" through "64" and the target gradation values "64" through "96" by use of the local coordinate (ξ, η), such an area is defined as an area enclosed by the following four points: P21(0, 0); P22(32, 0); P23(32, 32); and P24(0, 32).

Here, an interpolation equation is defined so as to find the first interpolation value H (i.e., the table interpolation value). For instance, when the interpolation equation is defined by the linear expression for the local coordinate (ξ, η), aξ+bη+c=H is satisfied. In order to find the first interpolation value H, a total of three unknowns should be found. Thus, it is necessary to acquire at least three points to find such three unknowns.

Figure 4:
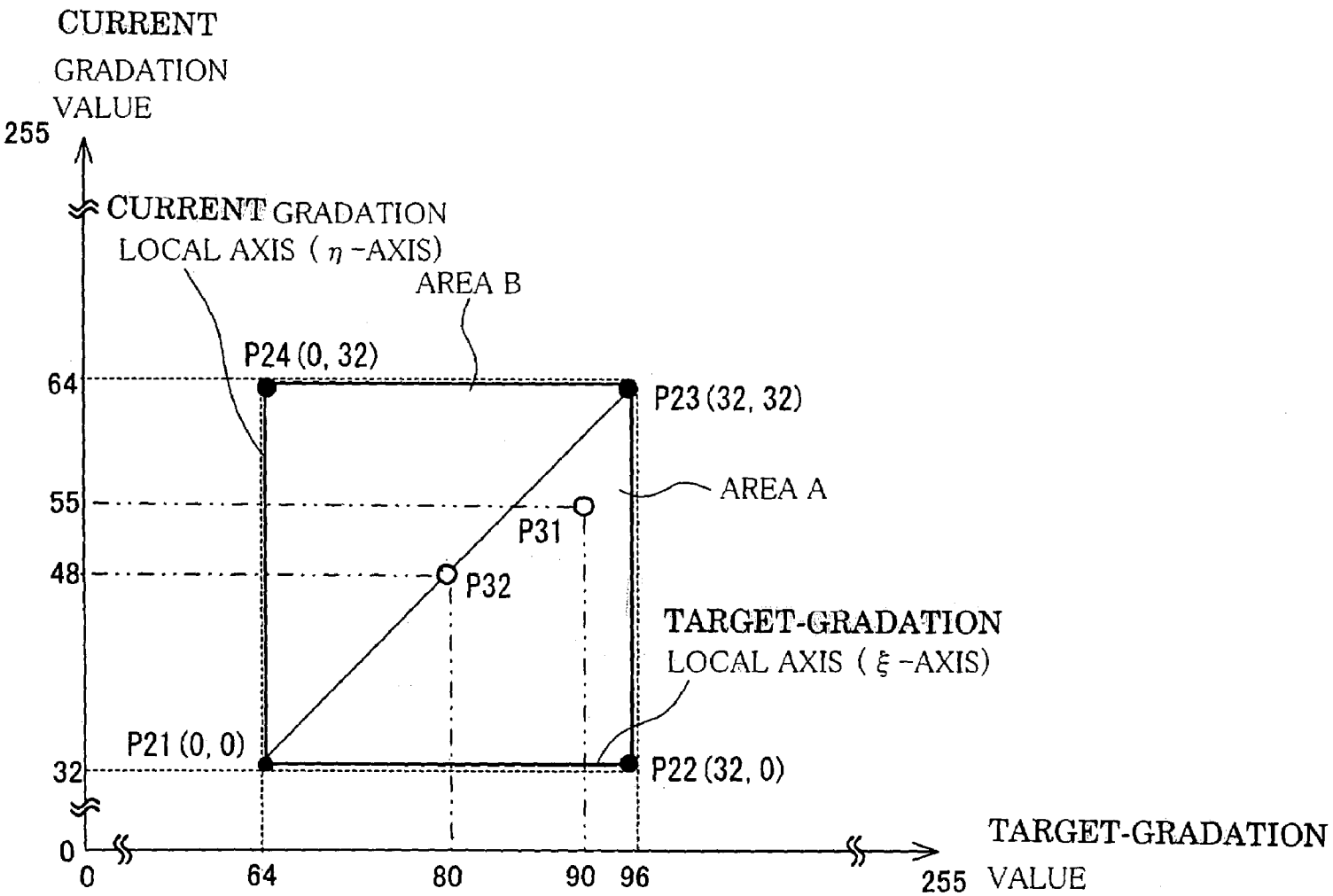
FIG. 4 is a graph showing a two-dimensional local coordinate system for use in the liquid crystal display apparatus of an embodiment of the present invention.

The case where the current gradation value "55" is changed into the target gradation value "90" is displayed in FIG. 4 as point P31. Note that the point P31 is represented by the local coordinate (target gradation value, current gradation value)=(90, 55).

In order to find the first interpolation value H of the point P31, at least three points should be used as described before. For this, an area defined by three points including the point P31 is selected from the area defined by the known four points P21, P22, P23, and P24. In the case of the point P31', the area (see area A in FIG. 4) enclosed and defined by the three points P21, P22, and P23 corresponds to such an area to be selected.

In the area A, the following interpolation operation is carried out based on the linear expression (aξ+bη+c=H) by use of (i) the already known target gradation values and current gradation values of the respective points P21, P22, and P23 and (ii) the gradation data of Table 1 (LUT) corresponding to the above three points. Namely, when using the known points, the gradation data corresponding to the local coordinate (ξ, η)=(target gradation value, current gradation value) is selected from Table 1 and substituted into the equation (aξ+bη+c=H) so as to carry out the interpolation operation.

More specifically, 0a+0b+c=92 is satisfied for the point P21, 32a+0b+c=118 is satisfied for the point P22, and 32a+32b+c=105 is satisfied for the point P23. From these equations, a=26/32, b=−13/32, and c=92 are obtained.

Therefore, the first interpolation value H of the point P31(ξ, η)=(26, 23) is equal to 103.8 in accordance with the following interpolation equation (referred to as interpolation equation (1)).

$$(26/32)\times 26+(-13/32)\times 23+92=103.8 \quad (1)$$

(Procedure 2)

Next, the second interpolation operation is carried out between the current gradation values and the target gradation values in Table 2 like the foregoing Procedure 1.

More specifically, found is a value (the second interpolation value I (table interpolation value)), required for changing the current gradation value "55" into the target gradation value "90".

0a+0b+c=142 is satisfied for the point P21, 32a+0b+c=192 is satisfied for the point P22, and 32a+32b+c=123 is satisfied for the point P23. From these equations, a=25/16, b=−69/32, and c=142 are obtained.

Therefore, the second interpolation value I is equal to 133.0 in accordance with the following interpolation equation (referred to as interpolation equation (2)).

$$(25/16)\times 26+(-69/32)\times 23+142=133.0 \quad (2)$$

Figure 5:
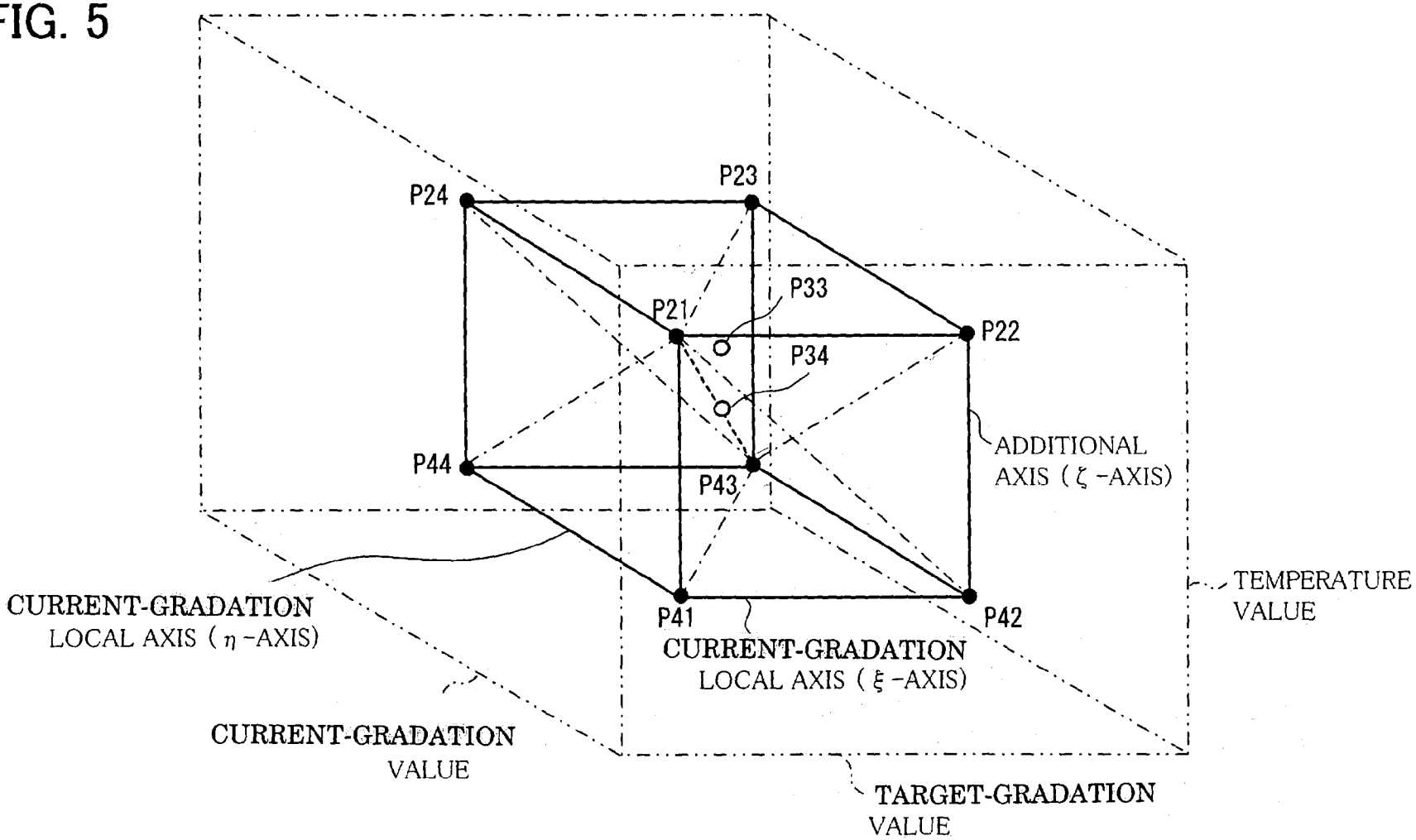
FIG. 5 is a graph showing a three-dimensional local coordinate system for use in the liquid crystal display apparatus of an embodiment of the present invention.

Note that the local coordinate system for finding the second interpolation value I is in the area defined by points P41, P42, P43, and P44 as shown in FIG. 5 which will be later described.

(Procedure 3)

The third interpolation value J for the intermediate temperatures 20° C. between 40° C. and 0° C. may be found in accordance with the third interpolation operation such as a linear interpolation operation by use of the respective first and second interpolation values H and I.

Therefore, the third interpolation value J is equal to 118.4 in accordance with the following equation.

$$(103.8+133.0)/2=118.4$$

The equation indicates that the third interpolation value J is equal to the average value of the first and second interpolation values H and I, i.e., (the first and second interpolation values H and I)/2.

Thus, in the case where it is intended to change the current gradation value "55" into the target gradation value "90" at 20° C., it is necessary to apply a voltage corresponding to the gradation data of "118" or "119" according to Procedures 1 through 3.

Note that the interpolation operation adopted in Procedure 3 is not limited to the linear interpolation operation. According to various embodiments of the present invention, a variety of interpolation operations, such as an interpolation operation in which a polynomial expression including a quadratic expression, may be used.

According to the liquid crystal display apparatus of the present embodiment, the interpolation operations are carried out by use of the local coordinate system during Procedures 1 and 2, and the interpolation operation is carried out by use of the additional condition such as temperature during Procedure 3, so that the final interpolation value, i.e., the target applied gradation data (the third interpolation value J for the above case) is found.

More specifically, the first and second interpolation operations are carried out during Procedures 1 and 2 based on the target gradation values and the current gradation values by use of Tables 1 and 2, respectively, and the third interpolation operation, which corresponds to the additional condition, is carried out during Procedure 3 by use of the results of the first and second interpolation operations (i.e., by use of the first and second interpolation values H and I).

Thus, the third interpolation value J corresponds to the additional condition such as temperature, for example. Of course, any such additional condition could be used. Further, since the first and second interpolation values H and I are found with high accuracy by use of the local coordinate system, the third interpolation value J has very high accuracy.

According to the liquid crystal display apparatus of the present embodiment, it is possible to find target applied gradation data which allow continuous output gradation based on the LUTs in which the output gradations corresponding to the finite combinations of two gradations are stored, under the additional condition such as temperature. When the display is carried out in accordance with the target applied gradation data, it is possible to obtain the display in which the gradation to be inputted is faithfully reproduced without raising unevenness of gradation or other defect.

Further, the accuracy of target applied gradation data is highly improved, as compared with a conventional interpolation value of the case where no local coordinate system is adopted and no additional condition such as temperature is considered.

In addition, since the target applied gradation data (applied gradation value) can be acquired without the use of LUTs for all the gradations and all the additional conditions, it is possible to reduce the capacity of the element such as memory for storing the LUTs.

Further, according to the present embodiment, by carrying out the linear interpolation between Tables 1 and 2, it is intended to prepare the LUT in which the output gradations corresponding to the finite combinations of two gradations are stored for an intermediate temperature between Tables 1 and 2. Thus, it is possible to selectively use three overshoot-driving Tables for low temperatures, intermediate temperatures, and high temperatures, respectively. In Procedure 3, after calculating two target applied gradation data based on two LUTs, the respective values are calculated in accordance with the additional condition. However, after finding an LUT corresponding to the additional condition based on the linear interpolation by use of two LUTs, the target applied gradation data may be calculated during Procedure 1 based on the LUT thus interpolated.

In the foregoing description, the point P31 is included only in the area A according to FIG. 4. In contrast, the point P32 is included in both areas A and B. This corresponds to the case of calculating the first interpolation value H (i.e., gradation data) required for changing the current gradation value "48" into the target gradation value "80". In such a case, the following describes that it is possible to calculate the first interpolation value H based on the interpolation equations based on the respective areas.

Note that similar interpolation proceeding may be carried out even in the case of setting two or more additional conditions, although only one additional condition is set for the interpolation operation in Procedure 3.

(Procedure 1')

Like Procedure 1, an interpolation equation is defined to calculate the first interpolation value H in Table 1. For instance, when the interpolation equation is defined by the linear expression for the local coordinate (ξ, η), it is necessary to select an area defined by three points including the point P31. Such an area may correspond to area A or area B in the case of the point P32. The area A corresponds to an area enclosed by the points P21, P22, and P23. The area B corresponds to an area enclosed by the points P21, P23, and P24.

More specifically, in the case of the area A, 0a+0b+c=92 is satisfied for the point P21, 32a+0b+c=118 is satisfied for the point P22, and 32a+32b+c=105 is satisfied for the point P23. From these three equations, a=26/32, b=−13/32, and c=92 are obtained, respectively.

Therefore, the first interpolation value H of the point P32((ξ, η)=(16, 16)) is equal to 98.5 in accordance with the following interpolation equation (referred to as interpolation equation (3)).

$$(26/32)\times16+(-13/32)\times16+92=98.5 \tag{3}$$

In the case of the area B, 0a+0b+c=92 is satisfied for the point P21, 32a+32b+c=105 is satisfied for the point P23, and 0a+32b+c=64 is satisfied for the point P24. From these three equations, a=41/32, b=−28/32, and c=92 are obtained, respectively.

Therefore, the first interpolation value H of the point P32((ξ, η)=(16, 16)) is equal to 98.5 in accordance with the following interpolation equation (referred to as interpolation equation (4)).

$$(41/32)\times16+(-28/32)\times16+92=98.5 \tag{4}$$

Thus, in the case where it is intended to change the current gradation value "48" into the target gradation value "80" at 40° C., i.e., in the case where both the areas A and B can enclose the point P32, it is possible to calculate the first interpolation value H based on the interpolation equation of either one of the areas, i.e., the interpolation equation (3) of the area A or the interpolation equation (4) of the area B.

This is because a single value exists on a boarder line (diagonal line) of the different areas A and B which is defined by the points P21 and P23 even when the first interpolation value H is calculated based on respective different interpolation equations (3) or (4). Namely, this is because there exists a point of tangency.

Therefore, the continuity of the first interpolation values H of the respective areas is maintained. Namely, no discontinuity of the interpolation value occurs on the boarder of the areas even when the interpolation equations of the respective different areas are used.

Since a single target applied gradation data exists on the border of the areas even when such a gradation data is calculated based on the interpolation equations of the respective different areas, i.e., based on two or more interpolation equations, it is possible to have broad options for selecting the interpolation equations.

Note that the continuity of the second interpolation value I of the respective areas is maintained like Procedure 1' even when Procedure 1' is carried out with regard to Table 2.

In the first embodiment, the local coordinate system is prepared for each LUT, and the first and second interpolation values H and I are calculated. The present invention, however, is not limited to this case. For example, the following second embodiment deals with another case.

Second Embodiment

The following description deals with another embodiment. Note that the same reference numerals are assigned to the members having the same functions as those of the first embodiment, and the explanation thereof is omitted here.

According to the second embodiment, the interpolation operation is carried out in accordance with a local coordinate system that concurrently uses Tables 1 and 2. Such a local coordinate system for the interpolation operation is shown, for example, in FIG. 5.

As shown in FIG. 5, in the local coordinate system having three axes for target gradation value, current gradation value, temperature value, respectively, an additional axis ($\zeta$-axis) is further provided in addition to the foregoing target gradation local axis ($\xi$-axis) and the current gradation local axis ($\eta$-axis) so as to form three-dimensional local coordinate system, the $\zeta$-axis being orthogonal to the $\xi$-axis and the $\eta$-axis.

Note for easier understanding that the following description deals with the case where the interpolation value K required for changing the current gradation value "48" into the target gradation value "80" at 30° C. is calculated.

The point P33 in FIG. 5 corresponds to the case where the interpolation value K required for changing the current gradation value "48" into the target gradation value "80" is calculated. The point P33 is located in a hexahedron enclosed by points 21 through 24 showing Table 1 and points 41 through 44 showing Table 2.

Here, an interpolation equation is defined in the three-dimensional local coordinate system so as to find the first interpolation value K. For instance, when the interpolation equation is defined by the linear expression for the local coordinate ($\xi$, $\eta$, $\zeta$), $a\xi+b\eta+c\zeta+d=K$ is satisfied. In order to find the first interpolation value K, totally four unknowns should be found. Thus, it is necessary to acquire at least four points to find such four unknowns.

For this, an area defined by four points including the point P33 is selected from the area defined by eight points P21 through P24 and points 41 through 44 whose gradation data are already known. In the case of the point P33, the area (the first area) enclosed and defined by the three points P21, P23, P22, and P43 corresponds to such an area to be selected.

The following interpolation operation is carried out based on the interpolation equation ($a\xi+b\eta+c\zeta+d=K$) by use of the already known target gradation values and current gradation values of the respective points P21, P22, P23, and P43 and the applied gradation data of Tables 1 and 2 corresponding to the above four known points. Like the foregoing first embodiment, when using the known points, the applied gradation data, corresponding to (target gradation value, current gradation value) for each temperature, that are the basis of each point ($\xi$, $\eta$, $\zeta$), are selected from Tables 1 and 2 and substituted into the equation ($a\xi+b\eta+c\zeta+d=K$) so as to carry out the interpolation operation.

More specifically, $0a+0b+40c+d=92$ is satisfied for the point P21, $32a+32b+40c+d=105$ is satisfied for the point P23, $32a+0b+40c+d=118$ is satisfied for the point P22, and $32a+32b+0c+d=123$ is satisfied for the point P43. From these four equations, $a=13/16$, $b=-3/32$, $c=-1/5$, and $d=100$ are obtained, respectively.

Therefore, the interpolation value K of the point P33(($\xi$, $\eta$, $\zeta$)=(16, 16, 30)) is equal to 105.5 in accordance with the following interpolation equation.

$$(13/16)\times16+(-3/32)\times16+(-1/5)\times30+100=105.5$$

Namely, in the case where it is intended to change the current gradation value "48" into the target gradation value "80" at 30° C., a voltage corresponding to the gradation data of "105" or "106" should be applied.

As has been described above, in the present embodiment, the interpolation operation is carried out by use of the three dimensional local coordinate system having three axes for target gradation value ($\xi$-axis), current gradation value ($\eta$-axis), and additional condition ($\zeta$-axis) so as to find a final interpolation value, i.e., a target applied gradation data (the interpolation value K in the second embodiment).

Thus, the interpolation value K is much more accurate, as compared with the conventional case where no local coordinate system is adopted and no additional condition such as temperature is considered. Further, the interpolation value K is much more accurate, as compared with the case where the local coordinate system is adopted, but no additional condition such as temperature is considered.

In other words, according to the liquid crystal display apparatus of the present embodiment, it is possible, under one or more of a plurality of additional conditions such as temperature for example, to calculate a target applied gradation data which is capable of realizing continuous output gradations by a plurality of LUTs in which the output gradations corresponding to the finite combinations of two gradations are stored. When a display is carried out in accordance with the target applied gradation data, it is possible to obtain the display in which the gradation to be inputted is faithfully reproduced without raising unevenness of gradation or other defect.

Note that the point P33 is included only in the area enclosed by the points P21, P23, P22, and P43 according to FIG. 5, the present embodiment is not limited to this. More specifically, the case where it is intended to calculate the interpolation value K required for changing the current gradation value "48" into the target gradation value "80" corresponds to a point P34 shown in FIG. 5. The point P34 is located at the center of a hexahedron enclosed by points 21 through 24 showing Table 1 and points 41 through 44 showing Table 2. Namely, the point P34 is included in the following first through sixth areas.

The first area is enclosed by the points P21, P23, P22, and P43, respectively. The second area is enclosed by the points P21, P22, P42, and P43, respectively. The third area is enclosed by the points P21, P42, P41, and P43, respectively. The fourth area is enclosed by the points P21, P41, P44, and P43, respectively. The fifth area is enclosed by the points P21, P44, P24, and P43, respectively. The sixth area is enclosed by the points P21, P24, P23, and P43, respectively.

In this case, it is possible to calculate the interpolation value K by use of an interpolation equation that is based on one of the first through sixth areas.

For instance, since the foregoing $a=13/16$, $b=-3/32$, $c=-1/5$, and $d=100$ can be used for the case of the first area, the interpolation value K of the point P34($\xi$, $\eta$, $\zeta$)=(16, 16, 20) is equal to 107.5 in accordance with the following interpolation equation.

$$(13/16)\times16+(-3/32)\times16+(-1/5)\times20+100=107.5$$

Further, the following equations are satisfied for the case of the third area.

More specifically, $0a+0b+40c+d=92$ is satisfied for the point P21, $32a+0b+0c+d=192$ is satisfied for the point P42, $0a+0b+0c+d=142$ is satisfied for the point P41, and $32a+32b+0c+d=123$ is satisfied for the point P43. From these four equations, $a=-50/32$, $b=31/32$, $c=-5/4$, and $d=142$ are obtained, respectively.

Therefore, the interpolation value K of the point P34((ξ, η, ζ)=(16, 16, 20)) is equal to 107.5 in accordance with the following interpolation equation.

$$(-50/32)\times16+(31/32)\times16+(-5/4)\times20+142=107.5$$

In the second and the fourth through sixth areas, the interpolation value K may be calculated by the method similar to the first and third areas, and the interpolation value K is equal to a single value of 107.5.

As described above, according to the liquid crystal display apparatus of the present embodiment, it is possible to calculate the interpolation value K by use of the interpolation equation for any one of the areas that includes a point, for instance, the point P34 in the second embodiment.

This is because the interpolation values K, calculated by the interpolation equations of the respective first through sixth areas, are equal to a single value of 107.5. In other words, this is because the different interpolation equations for the different areas are continuous on a boarder line (diagonal line) defined by the points P21 and P43, i.e., there exists a point of tangency. As a result, the interpolation values K are equal to a single value on the boarder line of the respective areas, thereby maintaining the continuity among the areas. In other words, the interpolation values on the boarder of the different areas will never be discontinuous even when using the interpolation equations of the respective different areas. Thus, the calculation of target gradation data by use of a space causes to have a single target gradation data. This ensures to have broad options for selecting the interpolation equations.

In the foregoing first and second embodiments, the interpolation equation is defined by the linear expression for the local coordinate. The present invention, however, is not limited to this. For instance, it is possible to calculate the interpolation value based on a quadratic expression. The following third embodiment deals with this kind of embodiment.

Third Embodiment

The following description deals with a further embodiment of the present invention. Note that the same reference numerals are assigned to the members having the same functions as those of the respective first and second embodiments. The explanation thereof will be omitted here.

In Procedure 1 (the first interpolation operation) of the first embodiment, when the interpolation equation is defined by a quadratic expression for (ξ, η), the interpolation equation is represented by $a\xi^2+b\eta^2+c\xi\eta+d\xi+e\eta+f=H$. In order to find the first interpolation value H, totally six unknowns (a, b, c, d, e, and f) should be found. Thus, it is necessary to acquire at least six points in the local coordinate shown in FIG. 6 to find such three unknowns.

In this case, like Procedure 1 of the first embodiment, in order to find the first interpolation value H corresponding to a point P31, an area (area A enclosed by points P21, P22, and P23) that includes the point P31 is selected from an area defined by known four points P21 through P24. And, the remaining three points, i.e., midpoints P51, P52, and P53 are found based on the known points by use of a method such as a linear interpolation. The midpoints are used as the remaining three points required for the first interpolation value H.

Note that the midpoints are not limited to the ones that have been found by use of the linear interpolation. The midpoints may be found by use of other interpolation operations. It is preferable to use points that have been actually measured instead of the midpoints, when it is intended to improve the accuracy of the interpolation operation. The finding of the midpoints implies to figure out the target gradation value, the current gradation value, and the gradation data. Accordingly, for instance, when it is assumed that (target gradation value, current gradation value, gradation data) of a midpoint P51, just located at the center between the points 22 and 23, is found based on the linear interpolation, (96, 48, 111.5) is found. In this case, (target gradation local axis (ξ-axis), (current gradation local axis (η-axis), gradation data)=(32, 16, 111.5) is satisfied.

Thereafter, the numeric values corresponding to (ξ, η), and the first interpolation value H are substituted so as to prepare the interpolation equations for the respective points P21 through P23 and the respective midpoints P51 through P53.

For instance, the interpolation equation of $32^2a+32^2b+(32\times32)c+32d+32e+f=105$ for the point P23((ξ, η)=(32, 32)) is obtained. Similarly, the interpolation equations are prepared for the respective points so as to find the unknowns a, b, c, d, e, and f, respectively. Then, it is possible to find the first interpolation value H based on the point P31((ξ, η)=(16, 16)) and the respective unknowns a, b, c, d, e, and f.

As has been described above, it is possible to further improve the interpolation accuracy when the polynomial expression is used as the interpolation equation, as compared with the case where the first interpolation value H is found based on the linear function equation. Similarly, it is possible to further improve the interpolation accuracy when the polynomial expression is used as the interpolation equation in the foregoing Procedure 2 of the first embodiment, as compared with the case where the second interpolation value I is found based on the linear expression. It is inevitable that the third interpolation value J has much higher accuracy when it is found based on the first and second interpolation values H and I, accordingly.

When the interpolation equation is defined by the quadratic expression for (ξ, η, ζ), the interpolation equation is represented by $a\xi^2+b\eta^2+c\zeta^2+d\xi\eta+e\eta\zeta+f\zeta\xi+g\xi+h\eta+i\zeta+j=K$. In order to find the interpolation value K, totally ten unknowns (a, b, c, d, e, f, g, h, i, and j) should be found. Thus, it is necessary to acquire at least ten points to find such ten unknowns in the local coordinate shown in FIG. 7. Note that $\xi\times\eta\times\zeta$ is not necessary in the interpolation equation because $\xi\times\eta\times\zeta$ implying a third-order function equation is not necessary in the quadratic expression.

In this case, like Procedure 2 of the second embodiment, in order to find the interpolation value K corresponding to a point P33, four points including the point P33 are selected from an area defined by the known points P21 through P24, and the points P41 through P44. And, as to the remaining six points, midpoints P51 through P56 are found based on the known points by use of a method such as a linear interpolation, like the midpoints P51 through P53 in the foregoing embodiment.

The numeric values corresponding to (ξ, η, ζ), and K are substituted so as to prepare the interpolation equations for the respective points P21 through P24 and the respective midpoints P51 through P56.

For instance, obtained is the interpolation equation of $32^2a+32^2b+40^2c+(32\times32)d+(32\times40)e+(40\times32)f+32g+32h+40i+j=105$ for the point P23((ξ, η, ζ)=(32, 32, 40)).

Similarly, the interpolation equations are prepared for the respective points so as to find the unknowns a, b, c, d, e, f, g, h, i, and j, respectively. Then, it is possible to find the interpolation value K based on the point P33((ξ, η, ζ)=(16, 16, 30)) and the unknowns a, b, c, d, e, f, g, h, i, and j.

As has been described above, it is possible to further improve the interpolation accuracy when the polynomial expression is used as the interpolation equation, as compared with the case where the interpolation value K is found based on the linear expression.

In the first through third embodiments, the target gradation data (for instance, the interpolation value K) is acquired in accordance with the temperature condition. In the present invention, the additional condition is not limited to the temperature. For instance, it is possible to acquire the target gradation data in accordance with other additional conditions such as thickness of cell and frequency of image for example, with a plurality of Tables and by using the Tables via the local coordinate system.

The area A including the point P23 (i.e., an area including the interpolation equation (1)) and the area B (i.e., an area including the interpolation equation (2)) are axis-symmetrical with respect to the diagonal line (i.e., axis of symmetry) defined by the points P21 and P23 (see FIGS. 4, 5, and 7), according to the first embodiment. This implies that the interpolation equations are continuous on the axis of symmetry. Further, the interpolation equations in the respective first thorough sixth areas are axis-symmetrical with respect to the diagonal line (i.e., the axis of symmetry) defined by the points P21 and P43 (see FIGS. 5 and 8), according to the third embodiment. This implies that the interpolation equations are continuous on the axis of symmetry, like the first embodiment.

Further, the number of the areas such as areas A and B and the first through sixth areas in the respective first through third embodiments has nothing to do with the number that has not been fixed. This is because the entire area including the areas A and B may be defined by arbitrary three points that have been already known. Namely, known points other than the points P21 through P24 may cause to freely change the number of the areas in the entire area. Such known points may be found based on the points P21 through P24 by use of an interpolation such as a linear interpolation.

Figure 6:
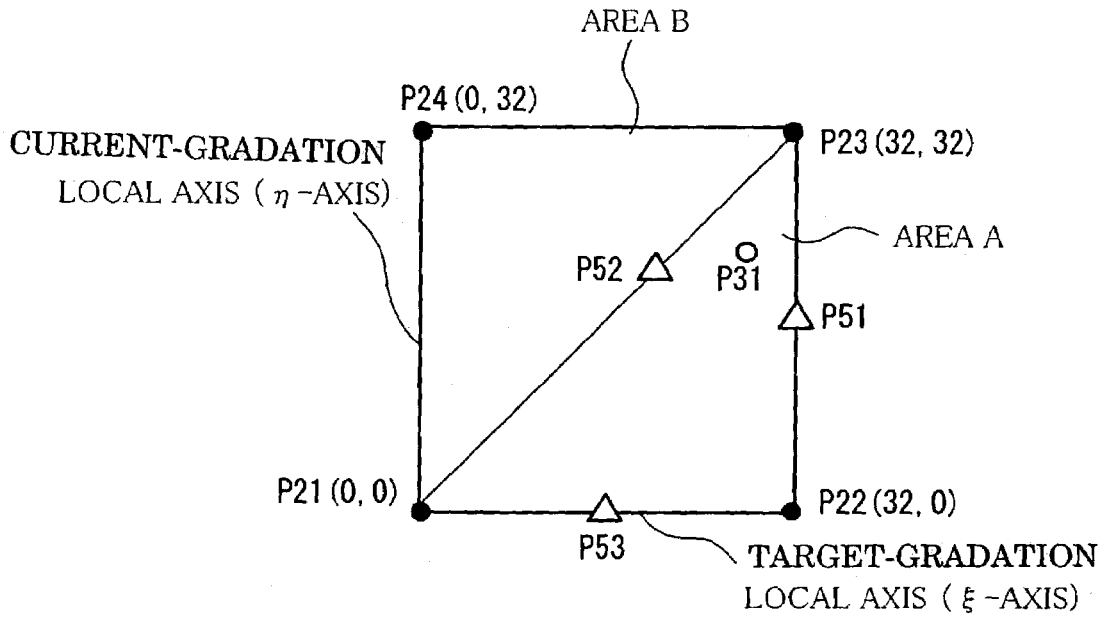
FIG. 6 is a schematic drawing in which a two-dimensional interpolation equation is used in the local coordinate system (two-dimensional local coordinate system) shown in FIG. 4.
Figure 7:
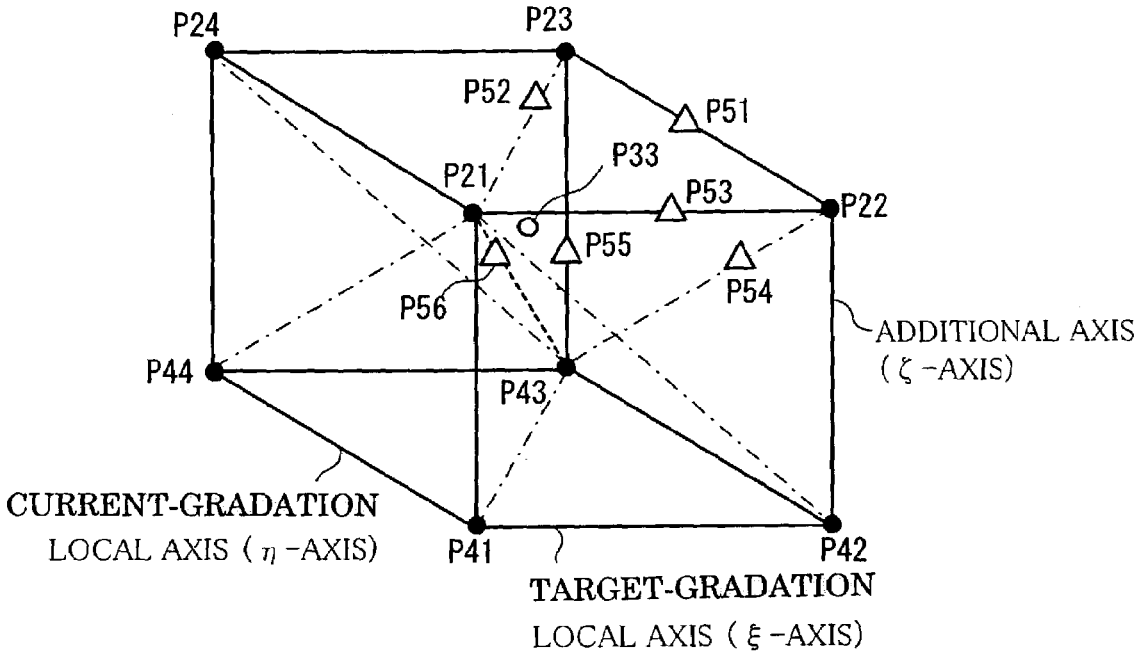
FIG. 7 is a schematic drawing in which a two-dimensional interpolation equation is used in the local coordinate (three-dimensional local coordinate) shown in FIG. 5.

The interpolation equation to be used represents a straight line shown in FIG. 4, a plane in the three-dimensional coordinate system shown in FIG. 5, an ellipsoid in the two-dimensional coordinate system shown in FIG. 6, and an ellipsoid solid in the three-dimensional coordinate system shown in FIG. 7.

The unit or program causing a voltage to be applied to the liquid crystal material of the liquid crystal panel is incorporated inside or outside a display controller.

The liquid crystal display apparatus of the present embodiment changes the applied voltage so as to carry out the gradation display, and carries out the overshoot-driving in which a voltage, that is greater than a voltage difference corresponding to the changing of gradation, is applied during the change in gradation. Further, the liquid crystal display apparatus of the present embodiment may be a display apparatus in which the applied voltages are changed over between at least two temperature ranges. An interpolation may be carried out by use of a local coordinate system with respect to (a) output gradation values corresponding to the finite combinations of two gradations or (b) an output gradation which varies depending on the additional condition such as temperature. Note that the similar results are obtained by the additional condition such as thickness of the cell of display panel and the frequency of the image for example, other than the temperature.

In the liquid crystal display apparatus of the present embodiment, the interpolation operation is carried out so that the space defined by the local coordinate system of the current gradations and the target gradations are divided into the areas defined by (n+1) apexes where the number of space axes is equal to n for the space coordinate defined by the gradation area represented by the local coordinate system or defined by an additional condition such as temperature With the arrangement, in the liquid crystal display apparatus, under the additional condition such as temperature, a calculation method is adopted in which the continuous output gradations are calculated based on a plurality of LUTs in which the output gradations corresponding to the finite combinations of two gradations are stored. This ensures to provide a method for carrying out a natural and high-speed display.

The liquid crystal display apparatus of the present embodiment may be expressed by the following features. Namely, the liquid crystal display apparatus changes the applied voltage so as to carry out a gradation display. In the apparatus, under the additional conditions such as at least two temperatures, at least two thicknesses of cells and at least two frequencies of images, the output gradation is set with respect to the respective gradations of current display and target display. The interpolation operation is carried out for output gradations, by use of the local coordinate system in association with the space axes defined by the additional condition such as temperature, thickness of cell, and frequency of image and by the gradations defined by the current display and the target display. This ensures to reduce the noise of image occurred due to the operation error by improving the continuity of the interpolation.

Thus, under the additional conditions such as temperatures, the thicknesses of cells and frequencies of images, the output gradation is calculated by use of the interpolation operation in the space defined by the additional condition such as temperature, thickness of cell, and frequency of image and the gradations of the current display and the target display. This ensures to reduce the resource such as memories and gates in light of hardware, and ensures to reduce the noise of image occurred due to the operation error by improving the continuity of the interpolation in light of software.

The liquid crystal display apparatus changes the applied voltage so as to carry out a gradation display. In the apparatus, the feature resides in that, under the additional conditions such as at least two temperatures, at least two thicknesses of cells and/or at least two frequencies of images for example, the output gradation is set with respect to the gradations of current display and target display. The interpolation operation is carried out for a plurality of additional conditions, by use of the local coordinate in association with the space axis defined by the additional condition such as temperature, thickness of cell, and/or frequency of image and the gradations defined by current display and target display. This ensures to improve the continuity of the interpolation so as to reduce the noise of image occurred due to the operation error.

Thus, under the additional conditions such as temperatures, thicknesses of cells and/or frequencies of images, the output gradation is calculated by use of the interpolation operation in the space defined by the gradations of the current display and the target display. This ensures to further reduce the resource such as memories and gates in light of hardware as compared with the above-described case, and ensures to reduce the noise of image occurred due to the operation error by improving the continuity of the interpolation in light of software.

In the liquid crystal display apparatus, the feature resides in that the interpolation operation is carried out so that the space defined by the local coordinate system is divided into the local areas defined by (n+1) apexes where the number of interpolation axes is equal to n, n being an integer of not less than two. This ensures to improve the continuity of the interpolation so as to reduce the noise of image occurred due to the operation error.

With the arrangement, it is possible by use of the local coordinate system to carry out the interpolation by linear expression during the multidimensional interpolation operation of n (n: integer of not less than two) interpolation axes. This ensures to reduce the resource such as memories and gates in light of hardware, and ensures to reduce the noise of image occurred due to the operation error by improving the continuity of the interpolation in light of software.

In the liquid crystal display apparatus, the feature resides in that the interpolation operation is carried out so that the space defined by the local coordinate system is divided into the local areas defined by (n+1) apexes and is carried out so that the apexes and each midpoint of respective sides are used when it is assumed that the number of interpolation axes is equal to n, n being an integer of not less than two. This ensures to improve the continuity of the interpolation so as to reduce the noise of image occurred due to the operation error.

With the arrangement, it is possible by use of the local coordinate system to carry out the interpolation operation by quadratic expression during the multidimensional interpolation operation of n (n: integer of not less than two) interpolation axes. This ensures to reduce the resource such as memories and gates in light of hardware, and ensures to reduce the noise of image occurred due to the operation error by improving the continuity of the interpolation in light of software.

Another liquid crystal display apparatus of an embodiment of the present invention has the following feature. More specifically, the apparatus has pixels, and applies to the pixels a gradation voltage (i.e., an applied voltage) which varies depending on gradation data (applied gradation value) for each frame. The apparatus is provided with (a) a memory section for storing the gradation data sequentially supplied as the gradation data of a target frame to be displayed and for delaying and outputting the gradation data by one frame so as to output it as gradation data of acurrent frame, (b) an LUT memory for storing, in accordance with an additional condition in advance, a plurality of LUTs indicative of gradation data of a target frame to be displayed that are specified by the gradation data to be displayed and by the gradation data of a current frame, (c) an additional condition measuring section for measuring the additional condition, (d) an applied gradation value acquiring section for receiving the gradation data of the target frame to be displayed, the gradation data of the frame to be outputted, the gradation data of the current frame supplied from the memory section and measured data of the additional condition, and for carrying out interpolation operation in reference to the LUTs so as to calculate applied gradation data. Further, the applied gradation value acquiring section sets for each LUT (1) a coordinate system in which a lattice point is represented by a combination of the gradation data of the target frame to be displayed and the gradation data of the current frame and (2) a local coordinate system having lattice points corresponding to the target gradation data in the coordinate system; carries out interpolation operation by use of the local coordinate system so as to calculate applied gradation data that have not been stored in the LUT as a table interpolation value; and carries out interpolation operation in accordance with the measured data by use of the table interpolation value for each LUT so as to calculate the target gradation data.

A further liquid crystal display apparatus of an embodiment of the present invention has the following features. More specifically, the apparatus has pixels, and applies to the pixels a gradation voltage (applied voltage) which varies depending on gradation data (applied gradation value) for each frame so as to carry out a gradation display. The apparatus is provided with (a) a memory section for storing the gradation data sequentially supplied as the gradation data of a target frame to be displayed and for delaying and outputting the gradation data by one frame so as to output it as gradation data of a current frame, (b) an LUT memory for storing, in accordance with an additional condition in advance, a plurality of LUTs indicative of gradation data of the target frame to be displayed that are specified by the gradation data to be displayed and by the gradation data of the current frame, (c) an additional condition measuring section for measuring the additional condition, (d) an applied gradation value acquiring section for receiving the gradation data of the target frame to be displayed, the gradation data of the current frame supplied from the memory section, and measured data of the additional condition, and for carrying out interpolation operation in reference to the LUTs so as to calculate gradation data required for gradation display as target applied gradation data. Further, the applied gradation value acquiring section sets (1) a coordinate system in which a lattice point is represented by a combination of the gradation data of the target frame to be displayed and the gradation data of the current frame and (2) a local coordinate system having points corresponding to the target gradation data; and carries out interpolation operation by use of the local coordinate system so as to calculate the target applied gradation data.

A liquid crystal display apparatus in accordance with an embodiment of the present invention, as has been described above, changes a voltage applied to a liquid crystal so as to carry out a gradation display and sets applied gradation values to be actually applied to the liquid crystal so as to be associated with a current gradation of a first frame and a target gradation of a second frame that is one frame later than the first frame. The apparatus is provided with (a) a plurality of look-up tables (LUTs), in which each applied gradation value is stored in association with the current gradation and the target gradation, provided in accordance with an additional condition that causes a response characteristic of the liquid crystal to change, and (b) applied gradation value acquiring section for acquiring, as the applied gradation value corresponding to the additional condition and a combination of the current gradation and the target gradation, in reference to the LUTs, an applied gradation value as it is (i.e., without modification) when the applied gradation value corresponding to the additional condition and the combination of the current gradation and the target gradation is stored in the LUT, and for acquiring a value that is interpolated by use of applied gradation values close to the additional condition and the combination of the current gradation and the target gradation that are stored in the LUT when the applied gradation value is not stored in the LUT, the applied gradation value acquiring section carrying out the interpolation operation in between the combinations of the current gradation and the target gradation by use of a local coordinate system in association with space axes defined by the current gradation and the target gradation.

The liquid crystal display apparatus, in general, applies to a pixel a voltage that varies depending on applied gradation value so as to carry out the gradation display. In a conventional liquid crystal display apparatus, an overshoot-driving is adopted in which the voltage applied to the liquid crystal is made to be greater than a voltage difference which varies depending on the difference between the gradations, when a current gradation corresponding to the gradation data of a current frame is changed to a target gradation corresponding to the gradation data of the next frame which is one frame later than the current frame.

The applied gradation value, indicative of the applied voltage that varies depending on the applied gradation value during the changing from the current gradation to the target gradation, is stored in the LUT in association with the current gradation and the target gradation. The applied gradation value is found from the LUT so as to apply the applied voltage to the pixel for the gradation display.

According to the liquid crystal display apparatus of an embodiment of the present invention, the LUT is prepared so that the thinning is carried out with respect to the gradations for the purpose of suppressing the capacity of the element such as a memory that stores the LUTs. Namely, the current gradations and the target gradations are not stored for the entire gradations in the LUT. When the applied gradation value corresponding to the changing between two gradations, i.e., the applied gradation value directly corresponding to the combination of the current gradation and the target gradation is stored in the LUT, the applied gradation value acquiring section adopts and acquires it. In contrast, when the applied gradation value corresponding to the changing between the two gradations is not stored in the LUT, the applied gradation value acquiring section carries out the interpolation operation based on the applied gradation values close to the combination of the current gradation and the target gradation so as to acquire the target applied gradation value when the applied gradation value is not stored in the LUT.

Further, according to an embodiment of the present liquid crystal display apparatus, a plurality of LUTs is further provided in accordance with an additional condition that causes a response characteristic of the liquid crystal such as temperature to change so as to acquire the applied gradation value taking the additional condition into consideration. In this case, the LUTs are also prepared so that the thinning is carried out with respect to the temperatures for the purpose of suppressing the capacity of the element such as a memory that stores the LUTs so as to reduce the number of the LUTs. Namely, the LUTs are not prepared for the entire temperatures. When the LUT that is in conformity with the additional condition exists, the applied gradation value that is obtained in accordance with the value stored in the LUT is adopted. In contrast, when no LUT that is in conformity with the additional condition exists, a plurality of LUTs, close to the additional condition (LUTs close to a target temperature, when the additional condition is temperature), is prepared so as to carry out the interpolation operation based on the applied gradation value obtained from the respective LUTs, thereby ensuring to acquire the target applied gradation value that is in conformity with the additional condition.

In the liquid crystal display apparatus of an embodiment of the present invention, especially during the interpolation operation for acquiring the applied gradation value in consideration of (a) the additional condition and (b) a plurality of combinations of the current gradation and the target gradation, the interpolation operation in between the combinations of the target gradation and the current gradation adopts the local coordinate system in association with the space axes defined by the target gradation and the current gradation in the LUTs. The adoption of the local coordinate system ensures the interpolation area to be smaller than the case where the interpolation is carried out in the entire area. This allows compensation for the adequate accuracy of interpolation even by use of a simple interpolation such as a linear interpolation. Thus, it is possible to improve the accuracy of interpolation in between the combinations of the current gradation and the target gradation. This causes the value calculated by the interpolation operation in between the combinations of the current gradation and the target gradation to be closer to a value that is actually measured, thereby ensuring the continuity. Accordingly, even when the interpolation operation is carried out in a usual manner, it is possible to calculate with high accuracy the applied gradation value taking the additional condition into consideration.

Thus, according to an embodiment of the liquid crystal display apparatus, it is possible by the interpolation operation to find with accuracy the applied gradation value (i.e., interpolated value) in accordance with the additional condition, even under an effect due to an additional condition such as temperature, thickness and/or frequency of image (i.e., frame frequency). This is especially true when no LUT exists that is in conformity with the additional condition. Since the applied gradation value (interpolated value) in each LUT used for finding the final applied gradation value is calculated by use of the local coordinate system with accuracy, the applied gradation value thus calculated becomes a highly accurate interpolated value.

According to an embodiment of the liquid crystal display apparatus, it is possible to calculate with high accuracy the applied gradation value in consideration of an additional condition without increasing the capacity of the element such as a memory, as compared with the conventional liquid crystal display apparatus in which no local coordinate system is adopted and the interpolated value is calculated without considering the additional condition such as temperature. Accordingly, the adoption of the interpolation operation ensures the appropriate carrying out of overshoot-driving so as to realize the natural and high-speed display without being affected by the additional condition such as temperature, for example, while the capacity of the memory for storing the LUTs is reduced as little as possible.

It is preferable that the liquid crystal display apparatus of an embodiment of the present invention is structured in addition to the foregoing arrangement so that, when the interpolation operation is carried out by use of the local coordinate system, (a) the applied gradation value acquiring section selects four combinations of the current gradation and the target gradation that are close to a target combination to be acquired among the combinations of the current gradation and the target gradation that are stored in the LUT and (b) one of the four combinations is made to be an origin of coordinates of the local coordinate system and respective differences between the origin of coordinates and the other combinations are made to be local variables.

With the arrangement, when the local coordinate system is set, the four combinations of the current gradation and the target gradation that are close to a combination (i.e., a target combination gradation) to be acquired by the interpolation operation are displayed by the space axes defined by the current gradation and the target gradation, i.e., combinations close to the target combination are displayed by the space axes among the combinations of the current gradation and the target gradation that are stored in the LUT. Set is the local coordinate system in which one of the four combinations is made to be an origin of coordinates.

According to the local coordinate system, it is possible to more correctly specify the local coordinate system to which the target combination belongs, as compared with the local coordinate system defined by the current gradation and the target gradation without modification. This ensures that the interpolation accuracy of the applied gradation value (i.e., interpolated value) to be acquired improves, accordingly.

Another liquid crystal display apparatus in accordance with an embodiment of the present invention, as has been described above, changes a voltage applied to a liquid crystal so as to carry out a gradation display and sets applied gradation values to be actually applied to the liquid crystal so as to be associated with a current gradation of a first frame and a target gradation of a second frame that is one frame later than the first frame. The apparatus is provided with (a) a plurality of look-up tables (LUTs), in which each applied gradation value is stored in association with the current gradation and the target gradation, provided in accordance with an additional condition that causes a response characteristic of the liquid crystal to change, and (b) an applied gradation value acquiring section for acquiring, as the applied gradation value corresponding to the additional condition and a combination of the current gradation and the target gradation, in reference to the LUTs, the applied gradation value as it is when the applied gradation value corresponding to the additional condition and the combination of the current gradation and the target gradation is stored in the LUT, and for acquiring a value that is interpolated by use of applied gradation values close to the additional condition and the combination of the current gradation and the target gradation stored in the LUT. When the applied gradation value is not stored in the LUT, the applied gradation value acquiring section carries out the interpolation operation by use of a local coordinate in association with space axes defined by the current gradation, the target gradation, and an additional condition.

With the arrangement, when an applied gradation value corresponding to the target combination is stored in the LUT, such an applied gradation value, as it is, is outputted. In contrast, when no such a value is stored in the LUT, the interpolation operation is carried out.

The applied gradation acquiring section carries out the interpolation operation by use of a plurality of LUTs, in which the applied gradation values are stored in accordance with the additional condition such as temperature. In the interpolation operation, the local coordinate system is preferably adopted in association with the space axes defined by the target gradation, the current gradation, and the additional condition that are stored in the LUT. For instance, when the LUT exists that is in conformity with the additional condition, the applied gradation value (i.e., interpolated value) is acquired based on the interpolation operation such as a linear interpolation by use of the local coordinate system corresponding to the LUT.

In contrast, when no LUT exists that is in conformity with the additional condition, the applied gradation value (i.e., interpolated value) is acquired based on a plurality of LUTs close to the additional condition.

Thus, according to an embodiment of the liquid crystal display apparatus, it is possible by the interpolation operation to find with accuracy the applied gradation value (i.e., interpolated value) in accordance with the additional condition, even under the affect due to the additional condition such as temperature, thickness and frequency of image (i.e., frame frequency).

According to an embodiment of the liquid crystal display apparatus, it is possible to calculate with high accuracy the applied gradation value in consideration of the additional condition, as compared with the conventional liquid crystal display apparatus in which no local coordinate system is adopted and the interpolated value is calculated without considering the additional condition such as temperature. Accordingly, the adoption of the interpolation operation ensures to appropriately carry out the overshoot-driving so as to realize the natural and high-speed display without being affected by the additional condition such as temperature while the capacity of the memory for storing the LUTs is reduced as little as possible.

It is preferable that the liquid crystal display apparatus of an embodiment of the present invention is structured in addition to the foregoing arrangement so that, when the interpolation operation is carried out by use of the local coordinate system, (a) the applied gradation value acquiring section uses two LUTs close to the additional condition and selects respective four combinations of the current gradation and the target gradation close to a target combination to be acquired among the combinations of the current gradation and the target gradation that are stored in the LUTs and (b) one of the eight combinations is made to be an origin of coordinates of the local coordinate system that has the eight combinations, and respective differences between the origin of coordinates and the other combinations are made to be local variables.

With the arrangement, when the local coordinate system is set, two LUTs close to the additional condition are selected. In each of the two LUTs, selected are four combinations of the current gradation and the target gradation that are close to the combination (i.e., the target combination) to be acquired by the interpolation operation. Accordingly, totally eight combinations are selected because two LUTs are used. Set is the local coordinate system in which one of the eight combinations is made to be an origin of coordinates.

According to the local coordinate system, it is possible to more correctly specify the local coordinate system to which the target combination belongs, as compared with the local coordinate system defined by the current gradation and the target gradation without modification. This ensures that the interpolation accuracy of the applied gradation value (i.e., interpolated value) to be acquired improves, accordingly.

A further liquid crystal display apparatus in accordance with an embodiment of the present invention, as has been described above, changes a voltage applied to a liquid crystal so as to carry out a gradation display and sets applied gradation values to be actually applied to the liquid crystal so as to be associated with a current gradation of a first frame and a target gradation of a second frame that is one frame later than the first frame, and is characterized in that the apparatus is provided with (a) a plurality of look-up tables (LUTs) in which each applied gradation value is stored in association with the current gradation and the target gradation, and (b) an applied gradation value acquiring section for acquiring, as the applied gradation value corresponding to a combination of the current gradation and the target gradation, in reference to the LUTs, the applied gradation value as it is when the applied gradation value corresponding to the combination is stored in the LUT, and for acquiring a value that is interpolated by use of applied gradation values close to the combination stored in the LUT when the applied gradation value is not stored in the LUT, the applied gradation value acquiring section carrying out the interpolation operation by use of a local coordinate in association with space axes defined by the current gradation and the target gradation, when the interpolation operation is carried out.

With the arrangement, the applied gradation value corresponding to the combination (i.e., the target combination) of the current gradation and the target gradation to be acquired is calculated and acquired based on the local coordinate system in association with the space axes defined by the current gradation and the target gradation. Thus, according to the liquid crystal display apparatus, it is possible by the interpolation operation to find with higher accuracy the applied gradation value (i.e., the interpolated value), as compared with the applied gradation value acquired by the interpolation operation adopting no local coordinate system.

It is preferable that the liquid crystal display apparatus of an embodiment of the present invention is structured in addition to the foregoing arrangement so that, when the interpolation operation is carried out by use of the local coordinate system, (a) the applied gradation value acquiring section selects four combinations of the current gradation and the target gradation that are close to a target combination to be acquired among the combinations of the current gradation and the target gradation that are stored in the LUT and (b) one of the four combinations is made to be an origin of coordinates of the local coordinate system and respective differences between the origin of coordinates and the other three combinations are made to be local variables.

With the arrangement, when the local coordinate system is set, the four combinations of the current gradation and the target gradation that are close to a combination (i.e., a target combination) to be acquired by the interpolation operation are displayed by the space axes defined by the current gradation and the target gradation, i.e., combinations close to the target combination are displayed by the space axes, among the combinations of the current gradation and the target gradation that are stored in the LUT. Set is the local coordinate system in which one of the four combinations is made to be an origin of coordinates.

According to the local coordinate system, it is possible to more correctly specify the local coordinate system to which the target combination belongs, as compared with the local coordinate system defined by the current gradation and the target gradation without modification. This ensures that the interpolation accuracy of the applied gradation value (i.e., the interpolated value) to be acquired improves, accordingly.

It is preferable for the liquid crystal display apparatus of an embodiment of the present application to be arranged so that the applied gradation acquiring section divides the space defined by the local coordinate system into the areas defined by (n+1) apexes that respectively corresponds to the combinations of known applied gradation values where the number of coordinate axes is equal to n (n: integer of not less than 2) for the local coordinate system so as to carry out the interpolation operation for each divided area.

With the arrangement, for instance, a point (a target point) corresponding to the applied gradation value may be enclosed by four points, in the case of the local coordinate in association with the three-dimensional coordinate system defined by the respective three axes for the target gradation, the current gradation, and the additional condition. When it is intended to express the target point, that is expressed by the three coordinate axes (n=3) of the local coordinate system, in the simplest manner by use of the interpolation equation for interpolation operation, totally four unknowns are necessary. Four (=n+1=3+1) lattice points are necessary, accordingly. More specifically, when it is intended to carry out the interpolation operation by use of linear expression, four lattice points are necessary. Thus, according to the arrangement, it is possible to carry out the interpolation operation by use of the linear expression, thereby reducing the work for the calculation of the interpolation operation. This enables to reduce the physical quantity such as capacity of the memory.

It is preferable in the liquid crystal display apparatus that the applied gradation acquiring section carries out the interpolation operation based on midpoints of the sides defined by connecting the respective (n+1) apexes and based on the respective (n+1) apexes.

With the arrangement, the number of the points which can be used for the interpolation equation increases. Therefore, it is possible to carry out an interpolation operation in which polynomial expression such as quadratic expression is used, thereby realizing higher accuracy of interpolation than the linear expression.

As an alternative embodiment, various sets of four (for example) applied gradation values (to be applied to the liquid crystal) for groups of four current and desired target gradation values expressed as local coordinates may be stored together in memory blocks. Further, also within a memory block, variable values of "a", "b", and "c" of the linear expression for the local coordinate ($\xi$, $\eta$), $a\xi+b\eta+c=H$ may then be determined and stored with the four stored applied gradation values. One set of "a", "b", and "c" linear expression values may be determined and stored using three of the four stored applied gradation values as "up" values (used for current gradation values increasing to a higher target gradation value) and/or another set of "a", "b", and "c" linear expression values may be determined and stored using a different three of the four stored applied gradation values as "down" values (used for current gradation values decreasing to a lower target gradation value).

Then, in order to properly interpolate an appropriate gradation value H to actually be applied to the liquid crystal so as to carry out proper gradation display, for a current and target gradation value falling between stored values within a block, the corresponding stored "up" or "down" a "b" and "c" variable values of the block are used for precise interpolation. Thus, a precise interpolation for an appropriate applied gradation value H can be done from current and target gradation values expressed as local coordinates ($\xi$, $\eta$) using the stored linear expression values "a", "b" and "c" for the local coordinate system of the corresponding block. A non-limiting example is as follows.

Initially, sets of four applied gradation values (to be applied to the liquid crystal) for groups of four current and target gradation values expressed as local coordinates are stored together in a plurality of memory blocks of a look up table, for example. For example, in the ninth memory block, corresponding to the group of four current and target gradation values in table 1 of FIG. 3(*a*), the applied gradation values of 32 (corresponding to current gradation value 32 and target gradation value 32), 92 (current 32 and target 64), 64 (current 64 and target 64), and 24 (current 64 and target 32) may be stored. As these applied gradation values are known, the corresponding "up" and/or "down" values of "a", "b" and "c" of the linear expression for the local coordinate ($\xi$, $\eta$), $a\xi+b\eta+c=H$, are also known. Thus, they are also stored in the ninth memory block along with the applied gradation values. The stored "up" values are thus "a"=60/32; "b"=−28/32, and "c"=32. The stored "down" values are thus "a"=40/32; "b"=−10/32; and "c"=32.

As such, for a current and target gradation value not stored in memory, a precise applied gradation value can be quickly and easily interpolated using the stored values in the memory block. For the current gradation value 48 and target gradation value 56 corresponding to the local coordinate (48, 56) for example, the values in the ninth memory block are used since the current gradation value of 48 falls within the stored current gradation values of 32 and 64 of the ninth memory block, and since the target value of 56 falls within the stored target gradation values of 32 and 64. Further, the corresponding stored "up" "a", "b" and "c" values for the ninth memory block may be used as the current gradation value of 48 is to be increased to the target gradation value of 56. Entering the values into the linear expression $a\xi+b\eta+c=H$, for the local coordinate (48, 56), a precise applied gradation value H of 73 is quickly and efficiently determined.

Note that the interpolation operation adopted above is not limited to the linear interpolation operation. According to various embodiments of the present invention, each of a variety of the interpolation operations described in each of the various embodiments of the present application may be applied to the aforementioned memory block look-up aspect of the present application, such as an interpolation operation in which a polynomial expression including a quadratic expression, for example. In addition, the aforementioned memory block look-up can be applied when the interpolation equation is defined by the linear expression for the local coordinate ($\xi$, $\eta$, $\zeta$), $a\xi+b\eta+c\zeta+d=K$ is satisfied. Further, interpolations involving temperature and other additional conditions may also be done using memory blocks in a similar fashion, to find the interpolation values such as I and J, for example, in accordance with that previously described.

Thus, a liquid crystal display apparatus can be developed which includes at least one memory including a plurality of memory blocks, each block being adapted to store a plurality of gradation voltage values, each gradation voltage value being adapted to be applied to a liquid crystal display to change the display to a target gradation from a current gradation and each corresponding to a current and target gradation value pair in a local coordinate space. The liquid crystal display further includes an applied gradation value acquiring section adapted to interpolate a gradation voltage value, adapted to be applied to the liquid crystal display to change the display to a desired target gradation from a currently displayed gradation. An applied gradation value is adapted to be determined by interpolation using a memory block of the at least one memory including gradation voltage values proximate to currently displayed and desired target gradation values within the local coordinate system. Further, the plurality of memory blocks may also be adapted to store variables usable in interpolating the gradation voltage value.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display apparatus, comprising:

at least one look-up table, adapted to store current and target gradation values in correspondence with gradation voltage values adapted to be applied to a liquid crystal display; and applied gradation value acquiring means for determining, with reference to the at least one look-up table, a gradation voltage value adapted to be applied to the liquid crystal display to change the display to a target gradation from a current gradation, wherein a corresponding applied gradation value is read from the at least one look-up table if the current and target gradation value being stored therein, and is otherwise determined by interpolation using a local coordinate system including current and target gradation axes and from applied gradation values stored in the at least one look-up table corresponding to current and target gradation values within the local coordinate system.

2. The liquid crystal display apparatus as set forth in claim 1, wherein the at least one look-up table includes at least one additional look-up table provided in accordance with an additional condition causing a response characteristic of the liquid crystal to change, wherein the applied gradation value to change the display to a target gradation from a current gradation varies depending on the additional condition, and wherein the applied gradation value acquiring means carries out the interpolation using the at least one additional look-up table.

3. The liquid crystal display apparatus as set forth in claim 2, wherein, when the interpolation operation is carried out using the local coordinate system, said applied gradation value acquiring means selects four combinations of stored current gradation and target gradation values proximate to the current gradation value and target gradation value to be displayed, and wherein one of the four combinations is used as an origin of coordinates of the local coordinate system, and wherein respective differences between the origin of coordinates and other three combinations are used as local variables.

4. The liquid crystal display apparatus as set forth in claim 2, wherein said applied gradation value acquiring means carries out the interpolation operation by use of a local coordinate system in association with axes defined by the current gradation, the target gradation, and the additional condition.

5. The liquid crystal display apparatus as set forth in claim 2, wherein the additional condition is temperature.

6. The liquid crystal display apparatus as set forth in claim 4, wherein, when the interpolation operation is carried out using the local coordinate system, said applied gradation value acquiring means uses two look-up tables proximate to the additional condition and selects respective four combinations of stored current gradation and target gradation values proximate to the current gradation value and target gradation value to be displayed, and wherein one of the eight combinations is used as an origin of coordinates of the local coordinate system that has the eight combinations and wherein respective differences between the origin of coordinates and the other combinations are used as local variables.

7. The liquid crystal display apparatus as set forth in claim 1, wherein, when the interpolation operation is carried out using the local coordinate system, said applied gradation value acquiring means selects four combinations of stored current gradation and the target gradation values proximate to the current gradation value and target gradation value to be displayed, and wherein one of the four combinations is used as an origin of coordinates of the local coordinate system and wherein respective differences between the origin of coordinates and the other three combinations are used as local variables.

8. The liquid crystal display apparatus as set forth in claim 1, wherein space defined by the local coordinate system is divided into areas defined by n+1 apexes that respectively correspond to combinations of stored applied gradation values, wherein a number of coordinate axes in the local coordinate system is equal to n, wherein n is an integer not less than 2, for the local coordinate system and wherein the applied gradation acquiring means is for carrying out the interpolation in any divided area.

9. The liquid crystal display apparatus as set forth in claim 8, wherein said applied gradation acquiring means carries out the interpolation operation based on midpoints of sides defined by connecting respective (n+1) apexes and based on the respective (n+1) apexes.

10. A liquid crystal display apparatus, comprising:

at least one look-up table, adapted to store current and target gradation values and corresponding gradation voltage values adapted to be applied to a liquid crystal display; and applied gradation value acquiring means for determining, in reference to the at least one look-up table, a gradation voltage value adapted to be applied to the liquid crystal display to change the display to a target gradation from a current gradation value, the applied gradation value being interpolated using applied gradation values stored in the at least one look-up table when an applied gradation value is not stored in the at least one look-up table, wherein said applied gradation value acquiring means carries out the interpolation operation using a local coordinate system defined by respective axes for current gradation and the target gradation.

11. A liquid crystal display apparatus, comprising:

at least one look-up table, adapted to store current and target gradation values and corresponding gradation voltage values adapted to be applied to a liquid crystal display; and applied gradation value acquiring means for determining, in reference to the at least one look-up table, a gradation voltage value adapted to be applied to the liquid crystal display to change the display to a target gradation from a current gradation value, the applied gradation value being interpolated using applied gradation values stored in the at least one look-up table when an applied gradation value is not stored in the at least one look-up table, wherein said at least one look-up table is prepared in accordance with at least one additional condition causing a response characteristic of the liquid crystal to change, and is prepared so that thinning is carried out with respect to the at least one additional condition, and wherein said applied gradation value acquiring means determines, as the applied gradation value, a value that is interpolated using applied gradation values stored in the at least one look-up table when a target look-up table that is in conformity with a target additional condition does not exist.

12. The liquid crystal display apparatus as set forth in claim 11, wherein space defined by the local coordinate system is divided into areas defined by n+1 apexes that respectively correspond to combinations of stored applied gradation values, wherein a number of coordinate axes in the local coordinate system is equal to n, wherein n is an integer not less than 2, for the local coordinate system and wherein the applied gradation acquiring means is for carrying out the interpolation in any divided area.

13. The liquid crystal display apparatus as set forth in claim 12, wherein said applied gradation acquiring means carries out the interpolation operation based on midpoints of sides defined by connecting respective (n+1) apexes and based on the respective (n+1) apexes.

14. A liquid crystal display apparatus, comprising:

at least one look-up table including a plurality of memory blocks, each block being adapted to store a plurality of gradation voltage values, each gradation voltage value being adapted to be applied to a liquid crystal display to change the display to a target gradation from a current gradation and each corresponding to a current and target gradation value pair in a local coordinate space; and an applied gradation value acquiring section adapted to interpolate a gradation voltage value to be applied to the liquid crystal display to change the display to a desired target gradation from a currently displayed gradation, wherein an applied gradation value is adapted to be determined by interpolation using a memory block of the at least one look-up table including gradation voltage values proximate to currently displayed and desired target gradation values within the local coordinate system.

15. The liquid crystal display of claim 14, wherein the plurality of memory blocks are further adapted to store variables usable in interpolating the gradation voltage value.

16. The liquid crystal display apparatus of claim 14, wherein the applied gradation value acquiring section is adapted to utilize a linear expression for interpolating the gradation voltage value.

17. The liquid crystal display apparatus of claim 14, wherein the applied gradation value acquiring section is adapted to utilize a linear expression for interpolating the gradation voltage value.

18. The liquid crystal display apparatus of claim 14, wherein the applied gradation value acquiring section is adapted to utilize a quadratic expression for interpolating the gradation voltage value.

19. The liquid crystal display apparatus of claim 15, wherein the applied gradation value acquiring section is adapted to utilize a quadratic expression for interpolating the gradation voltage value.

20. The liquid crystal display of claim 14, further comprising at least one additional look-up table, wherein each look-up table includes a plurality of blocks further corresponding to an additional condition.

21. The liquid crystal display of claim 20, wherein the applied gradation value acquiring section is adapted to interpolate a gradation voltage value using a memory block of at least two look-up tables.

22. The liquid crystal display of claim 15, further comprising at least one additional look-up table, wherein each look-up table includes a plurality of blocks further corresponding to an additional condition.

23. The liquid crystal display of claim 22, wherein the applied gradation value acquiring section is adapted to interpolate a gradation voltage value using a memory block of at least two look-up tables.

24. A liquid crystal display apparatus, comprising:

at least one look-up table including a plurality of memory blocks, each block being adapted to store a plurality of gradation voltage values, each gradation voltage value being adapted to be applied to a liquid crystal display to change the display to a target gradation from a current gradation and each corresponding to a current and target gradation value pair in a local coordinate space; and applied gradation value acquiring means for interpolating a gradation voltage value to be applied to the liquid crystal display to change the display to a desired target gradation from a currently displayed gradation, wherein an applied gradation value is determined by interpolation using a memory block of the at least one look-up table including gradation voltage values proximate to currently displayed and desired target gradation values within the local coordinate system.

25. The liquid crystal display of claim 24, wherein the plurality of memory blocks are further adapted to store variables usable in interpolating the gradation voltage value.

26. The liquid crystal display apparatus of claim 24, wherein the applied gradation value acquiring means utilizes a linear expression for interpolating the gradation voltage value.

27. The liquid crystal display apparatus of claim 25, wherein the applied gradation value acquiring means utilizes a linear expression for interpolating the gradation voltage value.

28. The liquid crystal display apparatus of claim 24, wherein the applied gradation value acquiring means utilizes a quadratic expression for interpolating the gradation voltage value.

29. The liquid crystal display apparatus of claim 25, wherein the applied gradation value acquiring means utilizes a quadratic expression for interpolating the gradation voltage value.

30. The liquid crystal display of claim 24, further comprising at least one additional look-up table, wherein each look-up table includes a plurality of blocks further corresponding to an additional condition.

31. The liquid crystal display of claim 30, wherein the applied gradation value acquiring means is for interpolating a gradation voltage value using a memory block of at least two look-up tables.

32. The liquid crystal display of claim 25, further comprising at least one additional look-up table, wherein each look-up table includes a plurality of blocks further corresponding to an additional condition.

33. The liquid crystal display of claim 32, wherein the applied gradation value acquiring means is for interpolating a gradation voltage value using a memory block of at least two look-up tables.

34. A liquid crystal display apparatus, comprising:

at least one look-up table, adapted to store current and target gradation values and corresponding gradation voltage values adapted to be applied to a liquid crystal display, wherein said at least one look-up table is prepared in accordance with at least one additional condition causing a response characteristic of the liquid crystal to change; and acquiring means for determining, in reference to the at least one look-up table, a gradation voltage value adapted to be applied to the liquid crystal display to change the display to a target gradation from a current gradation value.

35. The liquid crystal display apparatus as set forth in claim 34, wherein said at least one look-up table is further prepared so that thinning is carried out with respect to the at least one additional condition.

36. The liquid crystal display apparatus as set forth in claim 35, wherein said acquiring means determines, as the applied gradation value, a value that is interpolated using applied gradation values stored in the at least one look-up table when a target look-up table that is in conformity with a target additional condition does not exist.

* * * * *